US006779984B2

(12) United States Patent
Lilie et al.

(10) Patent No.: US 6,779,984 B2
(45) Date of Patent: Aug. 24, 2004

(54) POSITION SENSOR AND COMPRESSOR

(75) Inventors: Dietmar E. B. Lilie, Joinville (BR); Egidio Berwanger, Joinville (BR); Rinaldo Puff, Joinville (BR)

(73) Assignee: Empresa Brasileira de Compressores S.A. - Embraco (BR)

( * ) Notice: Subject to any disclaimer, the term of this patent is extended or adjusted under 35 U.S.C. 154(b) by 0 days.

(21) Appl. No.: 10/239,271

(22) PCT Filed: Feb. 23, 2001

(86) PCT No.: PCT/BR01/00021

§ 371 (c)(1),
(2), (4) Date: Sep. 20, 2002

(87) PCT Pub. No.: WO01/71186

PCT Pub. Date: Sep. 27, 2001

(65) Prior Publication Data

US 2003/0118460 A1 Jun. 26, 2003

(30) Foreign Application Priority Data

Mar. 23, 2000 (BR) ..... 0001404

(51) Int. Cl.[7] ..... F04B 49/00
(52) U.S. Cl. ..... 417/63; 417/212; 92/60.5
(58) Field of Search ..... 417/415, 53, 396, 417/397, 398, 545, 212, 417; 137/508; 92/13, 60.5

(56) References Cited

U.S. PATENT DOCUMENTS 3,919,509 A * 11/1975 Schnitzius ..... 200/61.62
4,263,488 A 4/1981 Freitag et al.
4,297,083 A * 10/1981 von Petery ..... 417/53
4,778,353 A * 10/1988 Wiernicki ..... 417/53
5,003,136 A * 3/1991 Valenzona ..... 200/61.62
5,342,176 A * 8/1994 Redlich ..... 417/212
5,537,820 A * 7/1996 Beale et al. ..... 60/517
5,818,131 A * 10/1998 Zhang ..... 310/15
6,084,320 A * 7/2000 Morita et al. ..... 310/12

FOREIGN PATENT DOCUMENTS

EP 0 508 823 A1 10/1992
EP 0 909 896 A3 4/1999
GB 1 344 877 1/1974

* cited by examiner

*Primary Examiner*—Justine R. Yu
*Assistant Examiner*—Han L Liu
(74) *Attorney, Agent, or Firm*—Alston & Bird LLP

(57) ABSTRACT

A position sensor is provided, particularly a sensor applicable to a linear compressor, for detecting the position of the piston and preventing the latter from knocking against the head located at the end of its stroke. More particularly, there is provided a sensor, particularly one that is employable in detecting the position of a piston of a compressor, the piston being axially displaceable inside a hollowed body, the compressor comprising a valve blade, the blade being positioned between the head and the hollowed body, the sensor comprising a probe electrically connected to a control circuit, the probe being capable of detecting the passage of the piston by a point of the hollowed body and signaling this to the control circuit. An associated compressor employing such a sensor is also provided.

16 Claims, 4 Drawing Sheets

POSITION SENSOR AND COMPRESSOR

BACKGROUND OF THE INVENTION

Figure 1:
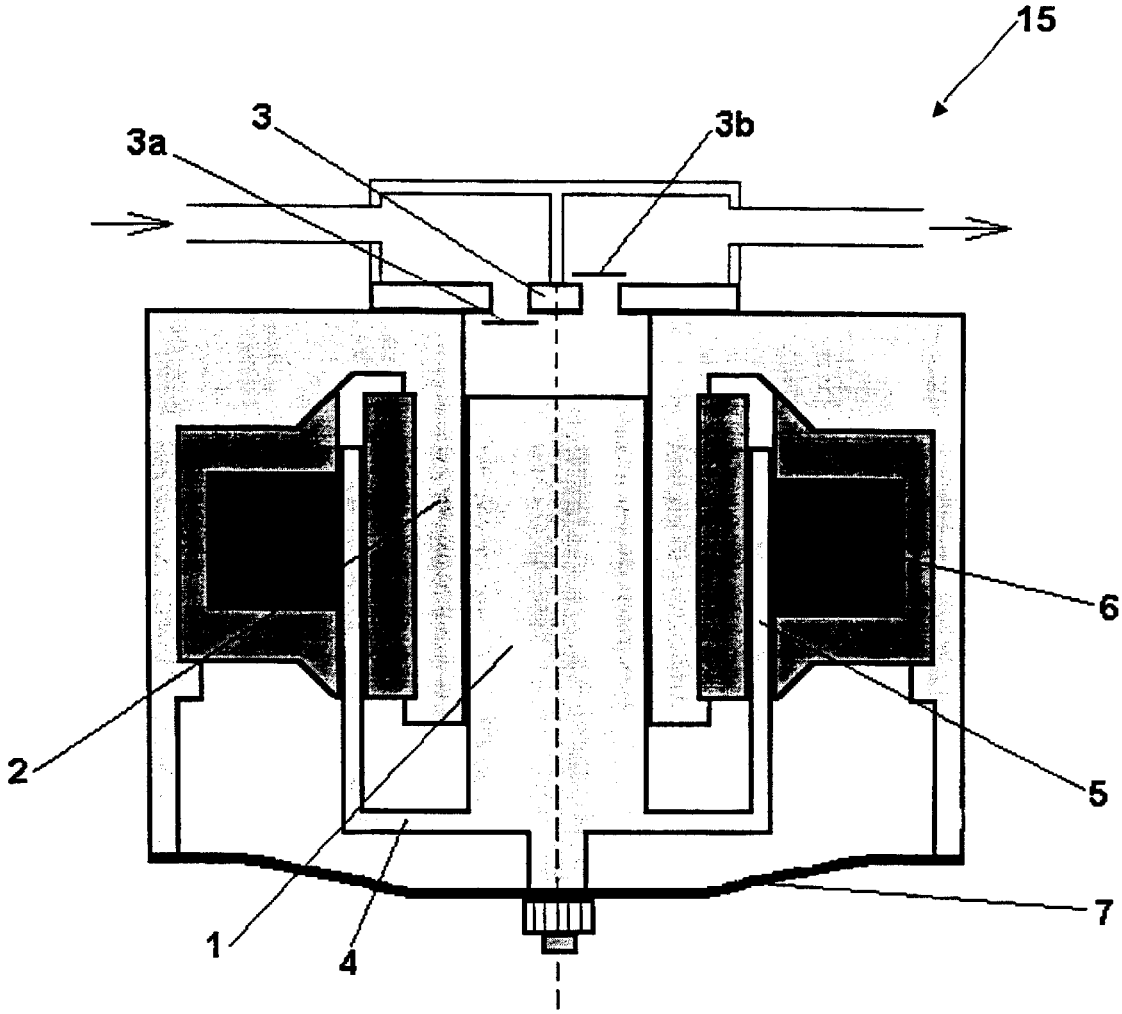

The present invention refers to a position sensor, particularly a sensor applicable to a linear compressor, for detecting the position of the piston, as well as to a compressor provided with a position sensor of its piston.

1. Field of the Invention

2. Description of Related Art

A linear compressor basically comprises a piston that can be axially displaced in a hollowed body, such piston compressing the gas used in the refrigeration cycle. Suction and discharge valves close to the end of the stroke of the piston regulate gas inlet and outlet in the cylinder or hollowed body. The piston is driven by an actuator that supports a magnetic component, which is driven by a linear motor. The piston is connected to a resonant spring and, together with the magnetic component and the spring, forms the resonant assembly of the compressor.

The resonant assembly, driven by the linear motor, has the function of developing a linear alternative movement, causing the movement of the piston inside the cylinder to perform an action of compressing the gas admitted by the suction valve as far as the point at which it can be discharged to the high-pressure side through the discharge valve.

Variations in the conditions of operation of the compressor, or variations in the feed voltage may cause the resonant assembly to displace beyond an acceptable limit, leading the top of the piston to knock against the head, thus causing noise and even damages to the compressor.

There are various solutions for controlling the movement of the piston so as to avoid collision of the piston with the head. One of them is to control the voltage level applied to the motor, so as to prevent the piston from advancing beyond the predetermined point and colliding with the head.

Other solutions detect the excess advance of the piston at the time of its collision with the head, thus not preventing damages to the compressor.

In order to avoid the above-cited problems, some solutions propose the use of position sensors, usually inductive transducers designed to detect the passage of the piston from a point close to the end of its stroke and to prevent it from knocking against the head. The problem of using these sensors lies in the fact that such devices are expensive and difficult to install, which raises the production costs of the compressor.

BRIEF SUMMARY OF THE INVENTION

The objective of the present invention is to provide a sensor capable of detecting the position of the piston, which prevent collision of the latter with the head altogether, is easy to construct and to install, thus reducing the production and manufacture costs of the compressor.

This objective is achieved by means of a sensor, particularly one that can be employed for detecting the position of a piston, the piston being axially displaceable in a hollowed body, the compressor comprising a valve blade, this blade being positioned between a head and the hollowed body, the sensor comprising a probe electrically connected to a control circuit, the probe being capable of detecting the passage of the piston at a point of the hollowed body and signaling this to the control circuit.

Another objective of the present invention is to provide a compressor having a sensor that is capable of detecting the passage of its piston at a point and signaling this to a circuit, with a view to prevent it from knocking against the head.

This objective is achieved by means of a compressor, particularly a linear one comprising a piston that is axially displaceable inside a hollowed body, the compressor comprising a valve blade, this blade being positioned between a head and the hollowed body, the compressor comprising a probe electrically connectable to a control circuit, the probe being capable of detecting the passage of the piston at a point of the hollowed body and signaling this to the control circuit.

BRIEF DESCRIPTION OF THE SEVERAL VIEWS OF THE DRAWING(S)

Figure 2:
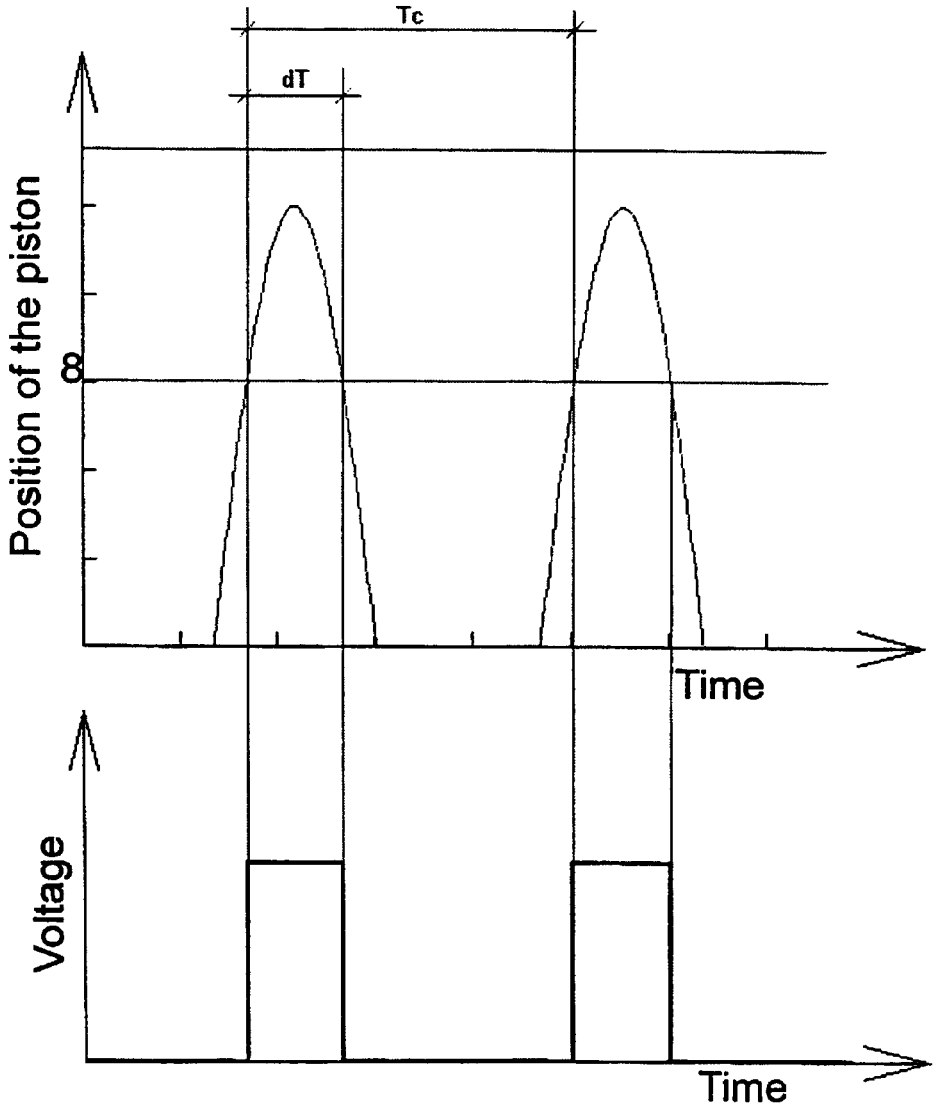
Figure 3:
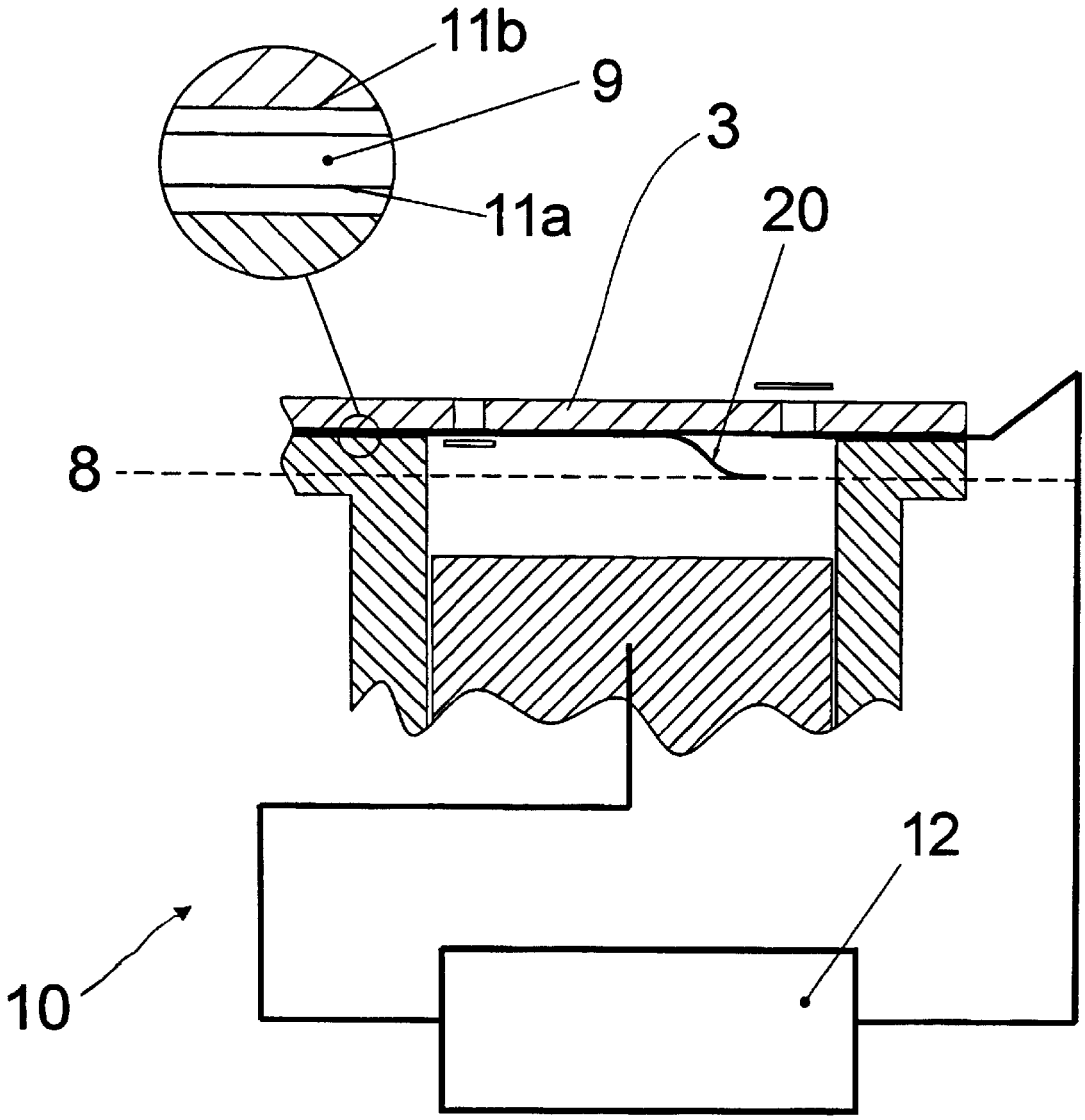
Figure 4:
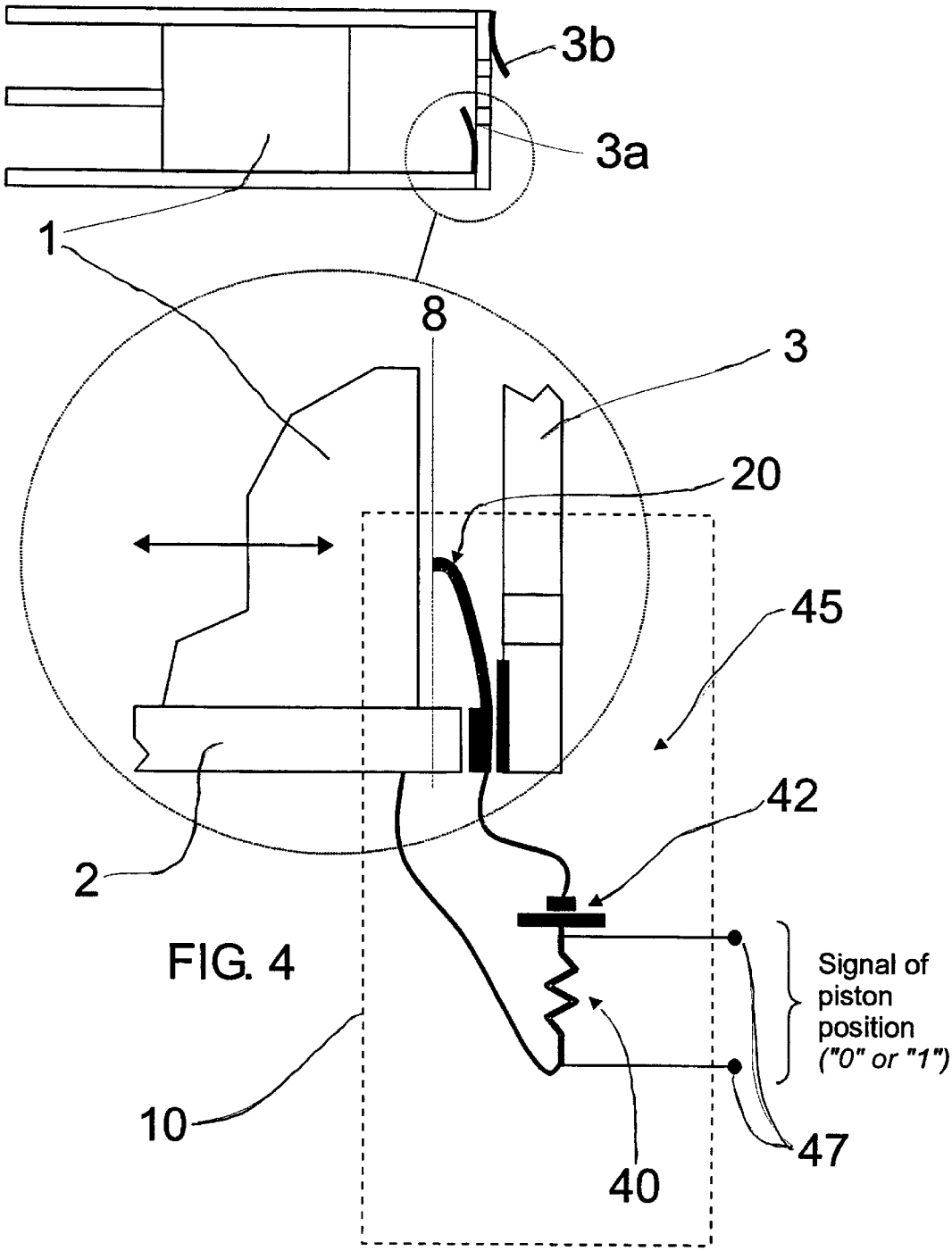

The present invention will now be described in greater detail with reference to an embodiment represented in the drawings. The figures show:

FIG. 1—a cross-section view of a linear compressor where the sensor of the present invention is installed;

FIG. 2—a time diagram view of the actuation of the sensor of the present invention;

FIG. 3—a partial cross-section view of a compressor provided with the sensor of the present invention; and FIG. 4—a partial view illustrating in detail the sensor of the present invention mounted in a linear compressor.

DETAILED DESCRIPTION OF THE INVENTION

As can be seen from FIGS. 1, 3, and 4, the compressor 15 comprises a piston 1 axially displaceable inside a generally cylindrical hollowed body 2. A head 3 located close to the end of the stroke of the piston 1 comprises the suction 3*a* and discharge 3*b* valves. An actuator 4 comprising a magnetic component 3 is actuated by the linear motor 6 and connected to the resonant spring 7, to form a resonant assembly of the compressor 15.

As can be seen in detail from FIGS. 3 and 4, a sensor 10 is arranged close to the head 3, which is capable of signaling the passage of the piston 1 at a maximum recommendable point 8, so as to prevent it from knocking against said head 3.

One of the possible solutions for embodying the sensor 10 is an electric circuit 45, which signals the passage of the piston 1 at the point 8, by means of a probe 20 that physically contacts said piston 1.

As shown in FIG. 4, the probe 20, manufactured from an electrically conductive material, is an integral part of the control circuit 12, which in turn comprises an electric circuit 45 that includes a source of electric voltage 42 (preferably in direct current) and a resistor 40, both of them connected in series to said probe 20 and to the body 2, or even to the piston 1, so as to signal the passage of the latter by the maximum point 8. In order to make this solution possible, the probe 20 must be electrically insulated from the body 2, so that the circuit 45 will be open, while the piston 1 remains on this side of the point 8. For this purpose, one can insulate electrically only the portion where said probe 20 contacts the body 2 or else insulate completely the head 3 by means of the electric insulators 11*a* and 11*b*, which may be the sealing joint themselves that exist for insulating the compressor 15 and preventing gas from escaping, which significantly reduces the manufacture costs of the latter.

The signaling of the passage of the piston by the point 8 causes a voltage level measured at the terminals 47 (positioned close to the resistor 40 ) to pass from the logical level "0" to the logical level "1". This variation can be easily read by the control circuit 12, which may still include an electronic circuit (not shown) capable of interpreting the passage of the piston 1 at the point 8 and correcting its path, thus preventing its collision with the head 3. FIG. 2 shows a time diagram of the outlet of the circuit 45 at the terminals 47, where one can see that, when the piston 1 advances beyond the point 8 by a period of time dT, the logic level passes from "0" to "1", returning to "0" as soon as the piston 1 returns to this side of the point 8, this situation repeating after the passage of a Tc cycle.

The probe 20 should preferably be manufactured from the valve blade 9 itself. This valve blade 9 remains positioned between the head 3 and the body 2, further having the insulators 11*a* and 11*b*, positioned between such elements, as shown in FIG. 3, and is used for making the suction valve 3*a*. The probe 20 is embodied from an additional cut and a fold of the blade 9, so as to achieve a projection advancing inwardly of the body 2, configuring the probe 20, which is suitable for physical contact with the piston 1. The end portion of the projection that configure the probe 20 should be on a plane substantially farther away from the head 3 than the plane of the blade 9.

Preferably, the probe 20 is positioned at a point close to the end of the stroke of the piston 1, that is to say, substantially close to the head 3 within the body 2, but it may also be positioned at another point of the compressor 15, as for instance close to the end portion of the actuator 4, provided that the position of the piston 1 is adequately detected to the effect of avoiding problems of collision of the latter with the head 3.

In addition, the probe 20 should be designed in such a way, that it will always work in elastic regime, so that it can always return to the original position after being displaced/pressed by the piston 1 when the latter passes beyond the point 8.

A preferred embodiment having been described, one should understand that the scope of the present invention embraces other possible variations, being limited only by the contents of the accompanying claims, which include the possible equivalents.

What is claimed is:

1. A sensor device adapted to indicate a position of an axially displaceable piston within a hollow body of a compressor, the piston further being movable with respect to a head operably engaged with the body, the sensor device comprising:

a control circuit; and a probe comprising a valve blade operably engaged with at least one of the head and the body so as to form a valve with the head and to be disposed between the head and the piston, the probe being electrically connected to the control circuit and electrically insulated from the head and the body, the probe being configured to be capable of contacting the piston at a selected distance from the head, whereby contact between the probe and the piston is sensed by the control circuit.

2. A sensor according to claim 1, further comprising an electrical insulator disposed between the probe and at least one of the head and the body to electrically insulate the probe therefrom.

3. A sensor according to claim 2, further comprising a sealing joint disposed between the head and the body for providing a seal therebetween, wherein the sealing joint is configured as the electrical insulator.

4. A sensor according to claim 1, wherein the selected distance is configured so as to avoid contact between the piston and the head.

5. A sensor according to claim 1, wherein the probe further includes a projection, the projection comprising a portion of the valve blade configured to extend away from the head and toward the piston.

6. A sensor according to claim 5, wherein the portion of the valve blade further includes an end portion, the end portion being configured to extend the selected distance from the head.

7. A sensor according to claim 1, further comprising a source of electrical voltage and a resistor electrically connected in series between the probe and the body, the body being in electrical contact with the piston such that contact between the probe and the piston forms a closed electrical circuit, wherein the control circuit is configured to sense the closed electrical circuit.

8. A sensor according to claim 1, further comprising a source of electrical voltage and a resistor electrically connected in series between the probe and the piston, wherein contact between the probe and the piston forms a closed electrical circuit, and wherein the control circuit is configured to sense the closed electrical circuit.

9. A compressor comprising:

a hollow body;

a head operably engaged with the body;

a piston configured to be axially displaceable within the body and movable with respect to the head;

a control circuit; and a probe comprising a valve blade operably engaged with at least one of the head and the body so as to form a valve with the head and to be disposed between the head and the piston, the probe being electrically connected to the control circuit and electrically insulated from the head and the body, the probe being configured to be capable of contacting the piston at a selected distance from the head, whereby contact between the probe and the piston is sensed by the control circuit.

10. A compressor according to claim 9, further comprising an electrical insulator disposed between the probe and at least one of the head and the body to electrically insulate the probe therefrom.

11. A compressor according to claim 10, further comprising a sealing joint disposed between the head and the body for providing a seal therebetween, wherein the sealing joint is configured as the electrical insulator.

12. A compressor according to claim 9, wherein the selected distance is configured so as to avoid contact between the piston and the head.

13. A compressor according to claim 9, wherein the probe further includes a projection, the projection comprising a portion of the valve blade configured to extend away from the head and toward the piston.

14. A compressor according to claim 13, wherein the portion of the valve blade further includes an end portion, the end portion being configured to extend the selected distance from the head.

15. A compressor according to claim 9, further comprising a source of electrical voltage and a resistor electrically connected in series between the probe and the body, the body being in electrical contact with the piston such that contact between the probe and the piston forms a closed electrical circuit, wherein the control circuit is configured to sense the closed electrical circuit.

16. A compressor according to claim 9, further comprising a source of electrical voltage and a resistor electrically connected in series between the probe and the piston, wherein contact between the probe and the piston forms a closed electrical circuit, and wherein the control circuit is configured to sense the closed electrical circuit.

* * * * *